US010973098B1

(12) United States Patent
Chen et al.

(10) Patent No.: US 10,973,098 B1
(45) Date of Patent: Apr. 6, 2021

(54) LED BACKLIGHT DRIVING CIRCUIT AND ADDRESSING METHOD THEREOF

(71) Applicants: ANANAVI TECHNOLOGY CORPORATION, Hsinchu (TW); QCHIP TECHNOLOGY LIMITED, Wanchai Dist. (CN)

(72) Inventors: Kuan Yu Chen, Hsinchu (TW); Hung Chih Liu, Hsinchu (TW); Cheng Chung Tsao, Hsinchu (TW); Yung Chun Lin, Hsinchu (TW)

(73) Assignees: Ananavi Technology Corporation, Hsinchu (TW); QChip Technology Limited, Hong Kong (CN)

( * ) Notice: Subject to any disclaimer, the term of this patent is extended or adjusted under 35 U.S.C. 154(b) by 0 days.

(21) Appl. No.: 16/872,494

(22) Filed: May 12, 2020

(30) Foreign Application Priority Data

Mar. 9, 2020 (CN) ..... 202010156560.1

(51) Int. Cl.
*H05B 45/10* (2020.01)
*H05B 47/17* (2020.01)
*H05B 45/30* (2020.01)

(52) U.S. Cl.
CPC ..... *H05B 45/10* (2020.01); *H05B 45/30* (2020.01); *H05B 47/17* (2020.01)

(58) Field of Classification Search
CPC ..... H05B 45/00; H05B 45/10; H05B 45/30; H05B 47/17; H05B 47/185; G09G 3/3406; G09G 3/342; G09G 2320/0261; G09G 2320/0653; G02F 1/133602; G02F 1/133611
See application file for complete search history.

(56) References Cited

U.S. PATENT DOCUMENTS

| | | | | |
|---|---|---|---|---|
| 8,395,565 | B2 * | 3/2013 | Somerville | G09G 3/3216 345/76 |
| 8,928,701 | B2 * | 1/2015 | Kim | G09G 3/342 345/690 |
| 9,271,356 | B2 * | 2/2016 | Li | H05B 45/46 |
| 9,271,360 | B2 * | 2/2016 | Kuo | H05B 47/185 |
| 10,203,553 | B2 * | 2/2019 | Yang | G09G 3/3413 |
| 10,878,734 | B1 * | 12/2020 | Watsuda | G09G 3/32 |

* cited by examiner

*Primary Examiner* — Haissa Philogene
(74) *Attorney, Agent, or Firm* — Rosenberg, Klein & Lee

(57) ABSTRACT

A LED backlight driving circuit includes a plurality of driving integrated circuits coupled to a data transmission line and a plurality of selecting circuits respectively connected to the plurality of driving integrated circuits. In an addressing mode, the plurality of selecting circuits are used to select one driving integrated circuit from the plurality of driving integrated circuits to set an address. The plurality of driving integrated circuits can set addresses via input/output pins connected to LEDs. So a number of pins of the driving integrated circuit can be equal to or less than 4, which will rise a yield of the LED backlight driving circuit setting in a PCB or in a glass board.

14 Claims, 7 Drawing Sheets

LED BACKLIGHT DRIVING CIRCUIT AND ADDRESSING METHOD THEREOF

This application claims priority for China patent application no. 202010156560.1 filed on 9 Mar. 2020, the content of which is incorporated by reference in its entirely.

BACKGROUND OF THE INVENTION

Field of the Invention

The present invention relates to a driving circuit of a display device, particularly to a LED backlight driving circuit and an addressing method thereof.

Description of the Prior Art

The mini LED backlight module can implement local dimming and thus can achieve a high dynamic range (HDR), whereby the display device can have better contrast. The conventional mini LED backlight module is disposed on a printed circuit board or a glass plate. As the driving integrated circuit and the mini LED are growing smaller and smaller, it becomes more and more difficult to dispose the mini LED backlight module on a printed circuit board (PCB) or a glass plate.

FIG. 1 shows a conventional mini LED backlight driving circuit 10. The conventional mini LED backlight driving circuit 10 comprises a plurality of driving integrated circuits 12 sharing a data transmission line DT1 and a plurality of driving integrated circuits 14 sharing a data transmission line DT2. Each of the driving integrated circuits 12 and 14 includes a power pin VP connected to the input voltage Vin, a ground pin GND connected to a ground terminal, an input/output pin IOUT connected to at least one of LEDs L11, L12, L21 and L22, a data input pin SDI coupled to the data transmission line DT1 or DT2, and an addressing pin used to receive address Sad11, Sad12, Sad21 or Sad22. The data transmission line DT1 or DT2 provides brightness data BD1 or BD2 for all the driving integrated circuits 12 or 14. The driving integrated circuits 12 or 14 acquire corresponding control data from the brightness data BD1 or BD2 according to the address Sad11, Sad12, Sad21 or Sad22 to drive LEDs L11, L12, L21 or L22 connected thereto. As shown in FIG. 1, the driving integrated circuits 12 and 14 of the conventional LED backlight driving circuit 10 need at least 5 pins. However, it is likely to have a poor yield to attach the driving integrated circuits 12 and 14, which are miniaturized and each have at least 5 pins, to a PCB or a glass plate. in order to achieve an acceptable yield, the number of the pins of the driving integrated circuits 12 and 14 should decrease to less than 4.

SUMMARY OF THE INVENTION

One objective of the present invention is to provide a LED backlight driving circuit and an addressing method thereof, wherein the LED backlight driving circuit use driving integrated circuits each having four or fewer pins.

The present invention proposes a LED backlight driving circuit, which comprises a plurality of driving integrated circuits coupled to a data transmission line and a plurality of selecting circuits respectively connected to the plurality of driving integrated circuits. In an addressing mode, the plurality of selecting circuits selects driving integrated circuits from the plurality of driving integrated circuits for addressing, and only one driving integrated circuit is addressed at the same time point. The plurality of driving integrated circuits may be addressed via input/out pins connected to LEDs. Thereby, the present invention can remove the addressing pin from the driving integrated circuit. Thus, the driving integrated circuit of the present invention may use four or fewer pins. Therefore, the present invention can raise the yield in attaching the LED backlight driving circuit to PCB or a glass plate.

DETAILED DESCRIPTION OF THE INVENTION

Figure 1:
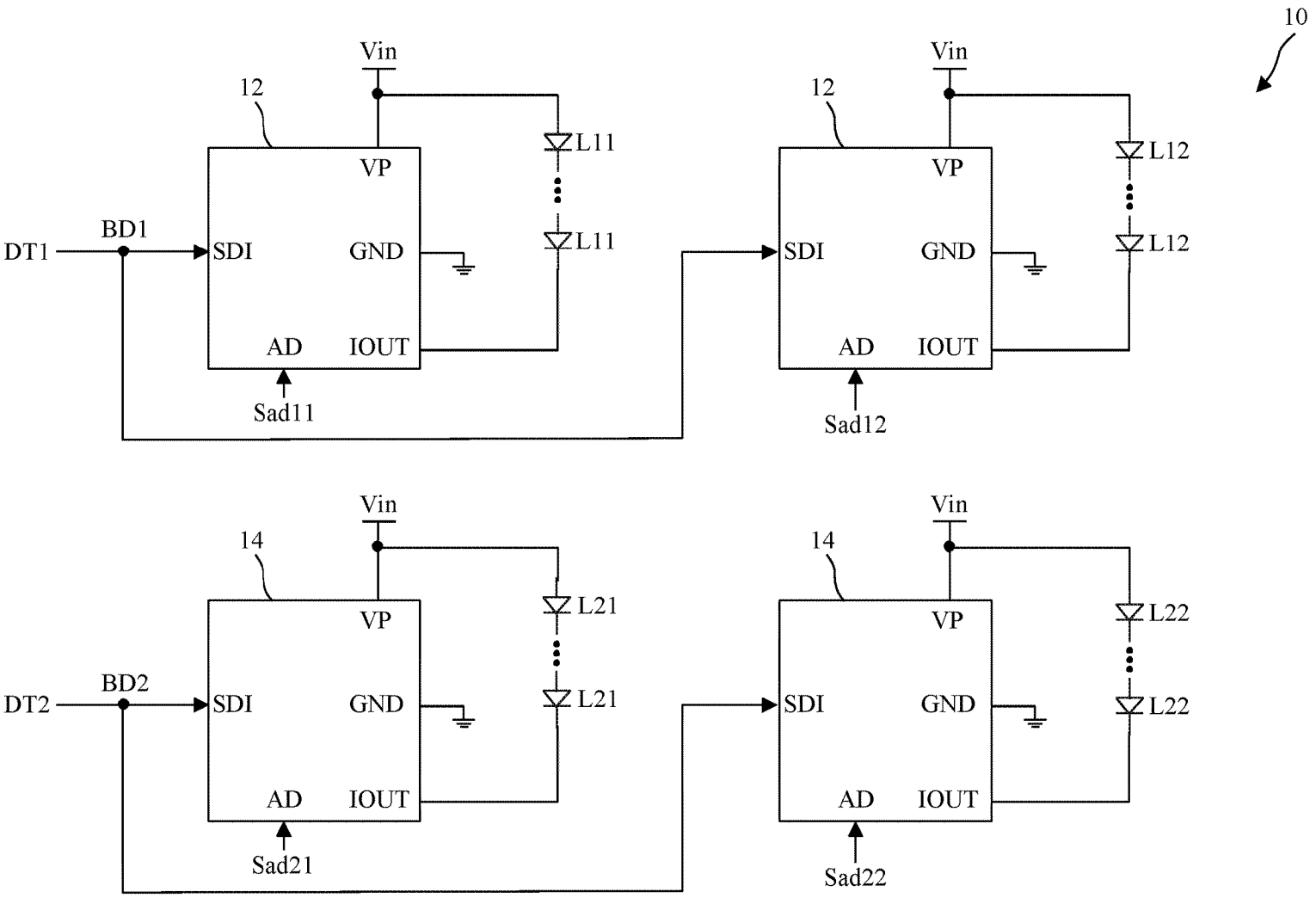
Fig. 1 Prior Art
FIG. 1 shows a conventional LED backlight driving circuit.
Figure 2:
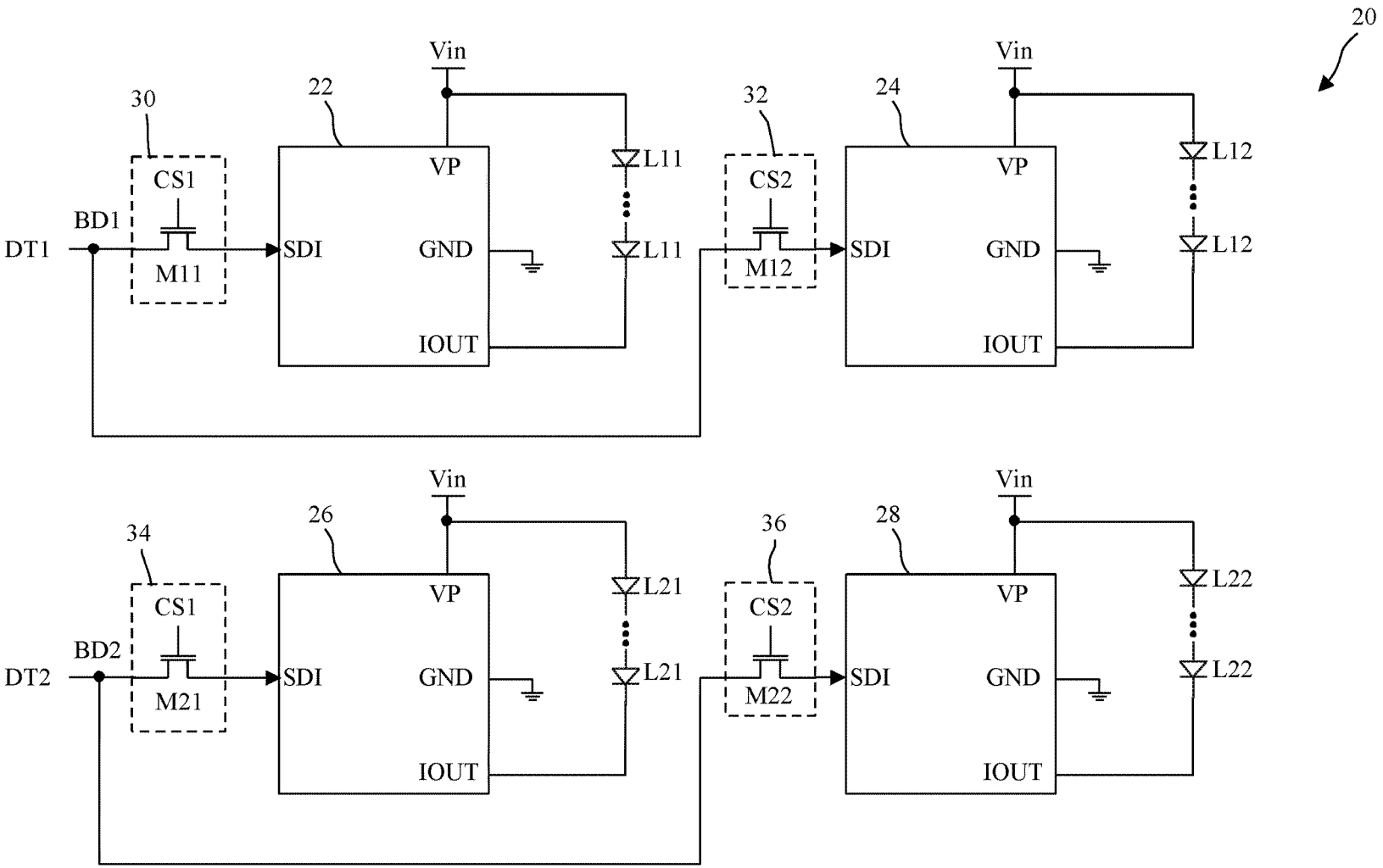
FIG. 2 shows a first embodiment of a LED backlight driving circuit of the present invention.

FIG. 2 shows a first embodiment of a LED backlight driving circuit according to the present invention. The LED backlight driving circuit 20 of the present invention may be used to drive various types of LEDs, such as mini LEDs or micro LEDs. In the embodiment shown in FIG. 2, the LED backlight driving circuit 20 is used to drive a plurality of LEDs L11, L12, L21 and L22. The LED backlight driving circuit 20 comprises a plurality of driving integrated circuits 22 and 24 sharing a data transmission line DT1 and a plurality of driving integrated circuits 26 and 28 sharing a data transmission line DT2. Each of the driving integrated circuits 22, 24, 26, and 28 has a power pin VP connected to an input voltage Vin, a ground pin GND connected to a ground terminal, an input/output pin IOUT connected to at least one of LEDs L11, L12, L21 and L22, and a data input pin SDI coupled to the data transmission line DT1 or DT2. The LED backlight driving circuit 20 further comprises a plurality of selecting circuits 30, 32, 34 and 36, which select the driving integrated circuits for addressing in an addressing mode. The selecting circuit 30 includes a switch M11 connected between the data transmission line DT1 and the data input pin SDI of the driving integrated circuit 22. The selecting circuit 32 includes a switch M12 connected between the data transmission line DT1 and the data input pin SDI of the driving integrated circuit 24. The selecting circuit 34 includes a switch M21 connected between the data transmission line DT2 and the data input pin SDI of the driving integrated circuit 26. The selecting circuit 36 includes a switch M22 connected between the data transmission line DT2 and the data input pin SDI of the driving integrated circuit 28. The switches M11 and M21 are controlled by a signal CS1; the switches M12 and M22 are controlled by a signal CS2. In one embodiment, while the LED backlight driving circuit 20 is applied to an LCD display device, the LED backlight driving circuit 20 may be disposed on a glass substrate of the LCD display device, and the switches M11, M12, M21 and M22 may be thin film transistors (TFT) controlled by the TFT driving circuit of the LCD display device. In one embodiment, the switches M11 and M21 are respectively controlled by different signals; the switches M12 and M22 are also respectively controlled by different signals.

Figure 3:
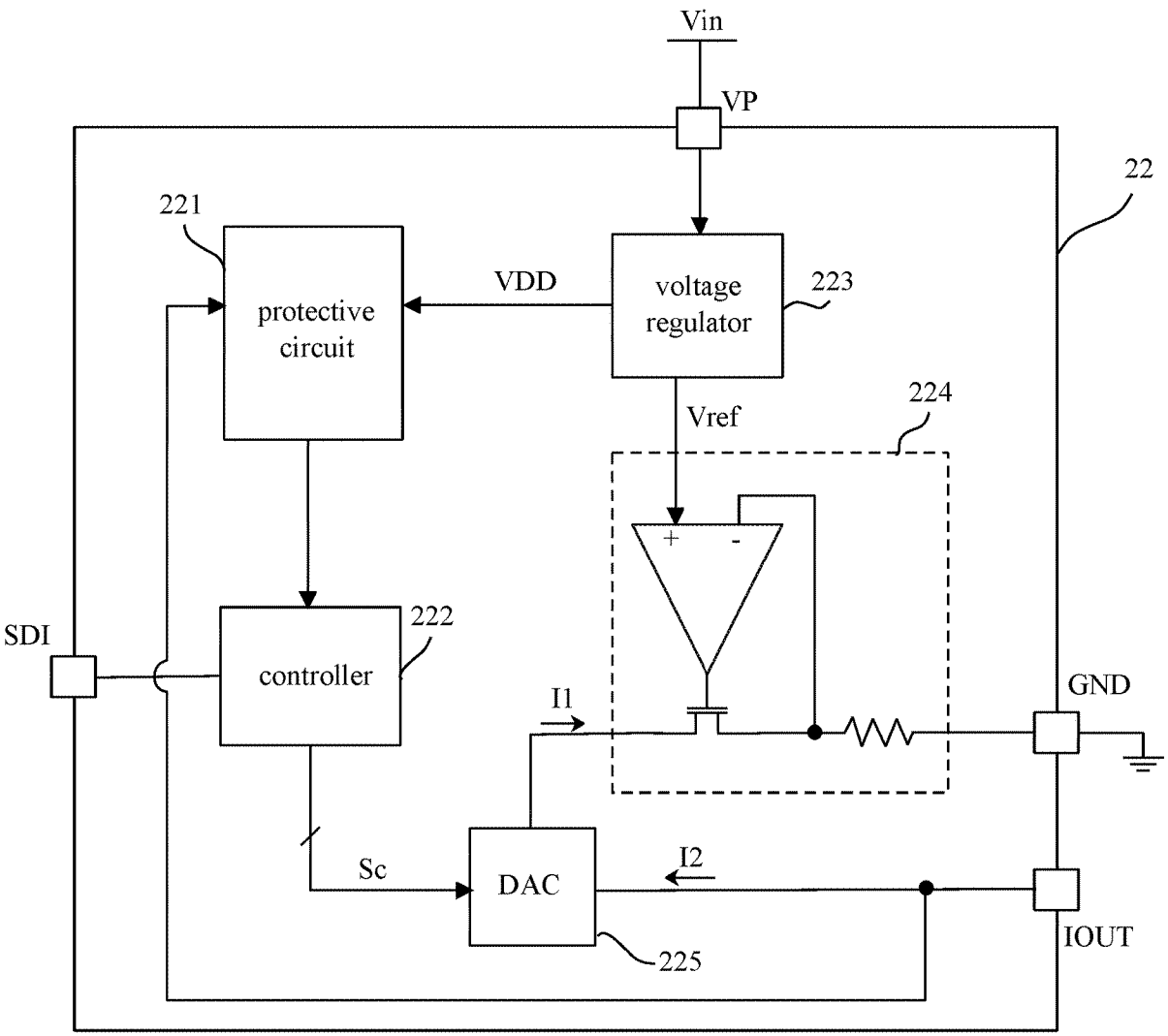
FIG. 3 shows an embodiment of the driving integrated circuit in FIG. 2.

FIG. 3 shows an embodiment of the driving integrated circuit 22 in FIG. 2. The driving integrated circuit 22 includes a protective circuit 221, a controller 222, a voltage regulator 223, a current source 224, and a digital to analog converter (DAC) 225. The voltage regulator 223 transforms the input voltage Vin into a voltage VDD and a voltage Vref After receiving the voltage VDD, the protective circuit 221 is started to perform protection functions. The protection functions include but not limited to over-voltage protection, short-circuit protection, over-temperature protection, and under-voltage lockout protection. The protective circuit 221 performs a corresponding protection function according to the result of detecting the voltage and current of the input/output pin IOUT. The current source 224 generates a constant current I1 according to the voltage Vref. The controller 222 is connected to the data input pin SDI and provides a control signal Sc. The DAC 225 is connected to the input/output pin IOUT and determines the current I2 flowing through LEDs 11 according to the control signal Sc and the constant current I1. The architectures of the driving integrated circuits 24, 26 and 28 are similar to that of the driving integrated circuit 22 and will not repeat herein.

Compared with the driving integrated circuits 12 and 14 of the conventional LED backlight driving circuit 10, the addressing pin AD is removed in the driving integrated circuits 22, 24, 26 and 28 of the present invention. Therefore, the LED backlight driving circuit 20 of the present invention needs an addressing method to address the driving integrated circuits 22, 24, 26 and 28. In one embodiment, the LED backlight driving circuit 20 may perform addressing in starting or during the vertical blank interval(VBI) of a frame. Refer to FIG. 2 and FIG. 3. After the LED backlight driving circuit 20 enters an addressing mode, the selecting circuits 30, 32, 34 and 36 select one driving integrated circuit for addressing. Each of the data transmission lines DT1 and DT2 would not connect with more than two driving integrated circuits at the same time. The driving integrated circuit connected with the data transmission line DT1 or DT2 may acquire an address from the data transmission line DT1 or DT2. In other words, during the addressing mode, the selecting circuits 30 and 32 select one of the driving integrated circuits 22 and 24 that share the data transmission line DT1 and make the selected one connected to the data transmission line DT1 for addressing; the selecting circuits 34 and 36 select one of the driving integrated circuits 26 and 28 that share the data transmission line DT2 and make the selected one connected to the data transmission line DT2 for addressing. While the signal CS1 turns on the switches M11 and M21, the driving integrated circuits 22 and 26 are respectively connected to the data transmission lines DT1 and DT2, which means that the driving integrated circuits 22 and 26 are selected for addressing. In the meanwhile, the signal CS2 turns off the switches M12 and M22 to disconnect the driving integrated circuits 24 and 28 from the data transmission lines DT1 and DT2. The data transmission lines DT1 and DT2 respectively provide addresses Sad11 and Sad21 for the driving integrated circuits 22 and 26. After receiving the addresses Sad11 and Sad21, the driving integrated circuits 22 and 26 store the addresses Sad11 and Sad21 in the address registers thereinside (not shown in the drawing). Thus, the addressing activities of the driving integrated circuits 22 and 26 are completed. After the addressing activities of the driving integrated circuits 22 and 26 are completed, the signal CS1 turns off the switches M11 and M21 to respectively disconnect the driving integrated circuits 22 and 26 from the data transmission lines DT1 and DT2. At the same time, the signal CS2 turns on the switches M12 and M22 to make the driving integrated circuits 24 and 28 respectively connected to the data transmission lines DT1 and DT2, which means that the driving integrated circuits 24 and 28 are selected for addressing. The data transmission lines DT1 and DT2 respectively provide addresses Sad12 and Sad22 for the driving integrated circuits 24 and 28. After the driving integrated circuits 24 and 28 store the addresses Sad12 and Sad22 in the address registers thereinside (not shown in the drawing), the addressing activities of the driving integrated circuits 24 and 28 are completed. In the embodiment shown in FIG. 2, each of the data transmission lines DT1 and DT2 is coupled to two driving integrated circuits only. However, in other embodiments, each of the data transmission lines DT1 and DT2 may be coupled to more than two driving integrated circuits. In such a case, the abovementioned process is repeated until all the driving integrated circuits are addressed. Then, the addressing mode is completed.

Figure 4:
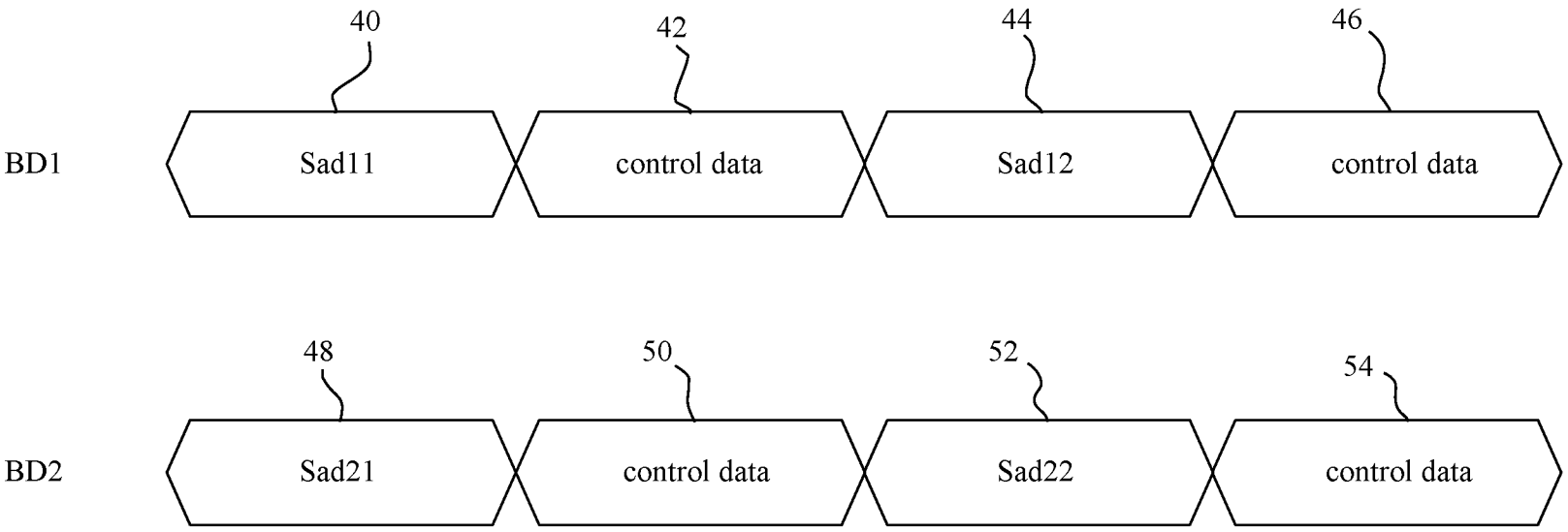
FIG. 4 shows an embodiment of brightness data BD1 and BD2.

After the addressing mode completes, the LED backlight driving circuit 20 enters a normal working mode. Refer to FIG. 2 and FIG. 3. In the normal working mode, the switches M11, M12, M21 and M22 are all turned on. Thus, the driving integrated circuits 22 and 24 are connected to the data transmission line DT1, and the driving integrated circuits 26 and 28 are connected to the data transmission line DT2. The data transmission lines DT1 and DT2 respectively provide brightness data BD1 and BD2. After receiving the brightness data BD1, the controllers 222 of the driving integrated circuits 22 and 24 acquire corresponding control data from the brightness data BD1 according to the addresses Sad11 and Sad12 stored thereinside. Then, the controllers 222 generate the control signals Sc according to the acquired control data to modify the currents I2 supplied to LEDs L11 and L12 so as to control the brightness of LEDs L11 and L12. Similarly, the controllers 222 of the driving integrated circuits 26 and 28 acquire corresponding control data from the brightness data BD2 according to the addresses Sad21 and Sad22 stored thereinside. Then, the controllers 222 generate a control signals Sc according to the acquired control data to control the brightness of LEDs L21 and L22. FIG. 4 shows an embodiment of the brightness data BD1 and BD2, where in address data 40, 44, 48 and 52 are respectively followed by control data 42, 46, 50 and 54. While the controller 222 of the driving integrated circuit 22 performs comparison and finds that the address data 40 matches the address Sad11 stored thereinside, the controller 222 stores the control data 42 following the address data 40. While the controller 222 of the driving integrated circuit 22 performs comparison and finds that the address data 44 does not match the address Sad11 stored thereinside, the controller 222 would not store the control data 46 following the address data 44. Similarly, the driving integrated circuit 24, 26 and 28 can acquire corresponding control data 46, 50 and 54 according to the addresses Sad12, Sad21 and Sad22.

Figure 5:
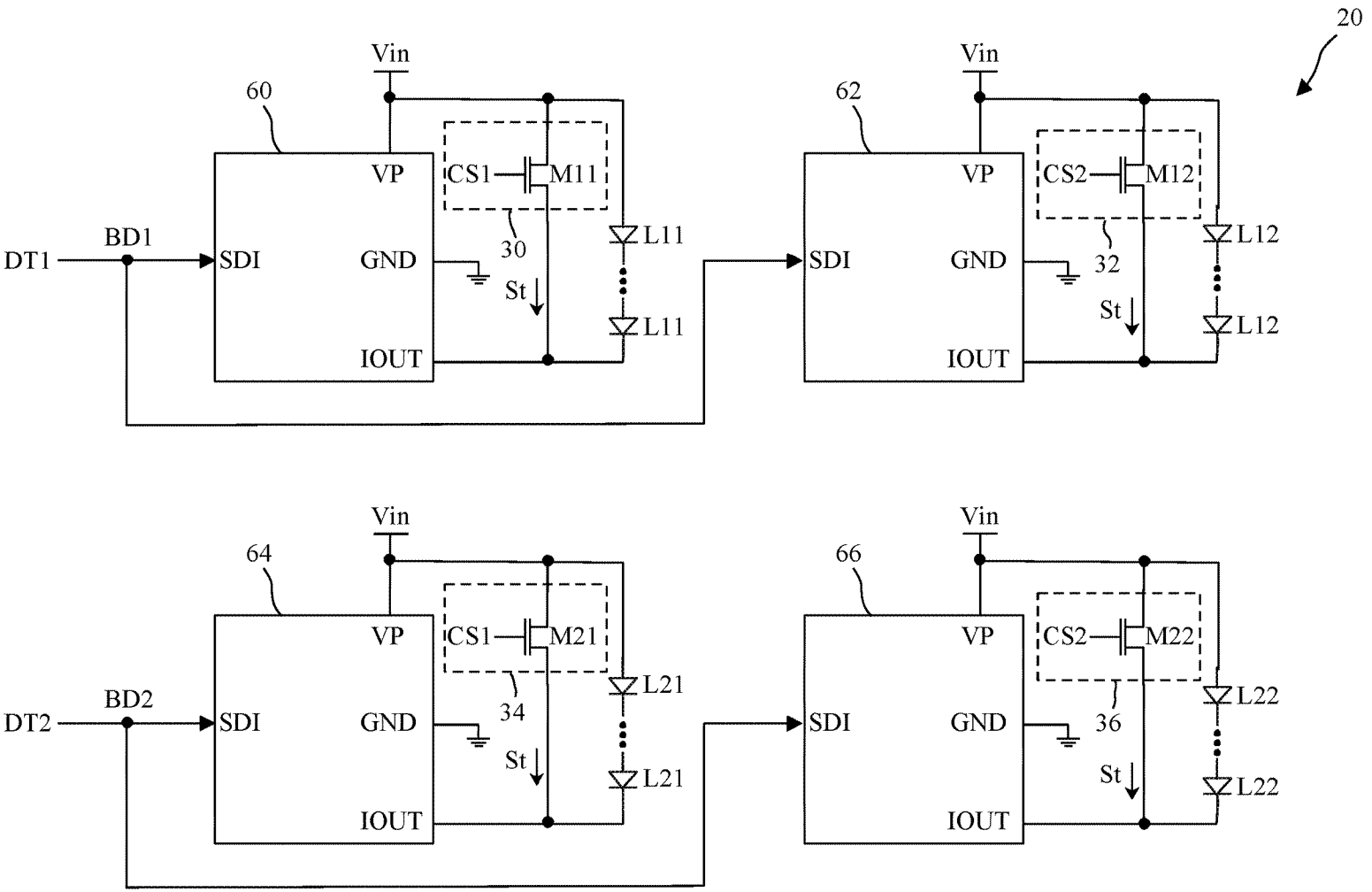
FIG. 5 shows a second embodiment of a LED backlight driving circuit of the present invention.

FIG. 5 shows a second embodiment of the LED backlight driving circuit 20. The LED backlight driving circuit 20 comprises a plurality of driving integrated circuits 60 and 62 connected to a data transmission line DT1 and a plurality of driving integrated circuits 64 and 66 connected to a data transmission line DT2. In a normal working mode, the plurality of driving integrated circuits 60, 62, 64 and 66 respectively drive LEDs L11, L12, L21, and L22. Each of the driving integrated circuits 60, 62, 64 and 66 has a power pin VP connected to an input voltage Vin, a ground pin GND connected to a ground terminal, an input/output pin IOUT connected to at least one of LEDs L11, L12, L21 and L22, and a data input pin SDI coupled to the data transmission line DT1 or DT2. The LED backlight driving circuit 20 further comprises a plurality of selecting circuits 30, 32, 34 and 36, which select the driving integrated circuits for addressing in an addressing mode. The selecting circuit 30 includes a switch M11 connected between the power pin VP and the input/output pin IOUT of the driving integrated circuit 60. The selecting circuit 32 includes a switch M12 connected between the power pin VP and the input/output pin IOUT of the driving integrated circuit 62. The selecting circuit 34 includes a switch M21 connected between the power pin VP and the input/output pin IOUT of the driving integrated circuit 64. The selecting circuit 36 includes a switch M22 connected between the power pin VP and the input/output pin IOUT of the driving integrated circuit 66. The switches M11 and M21 are controlled by a signal CS1; the switches M12 and M22 are controlled by a signal CS2.

Figure 6:
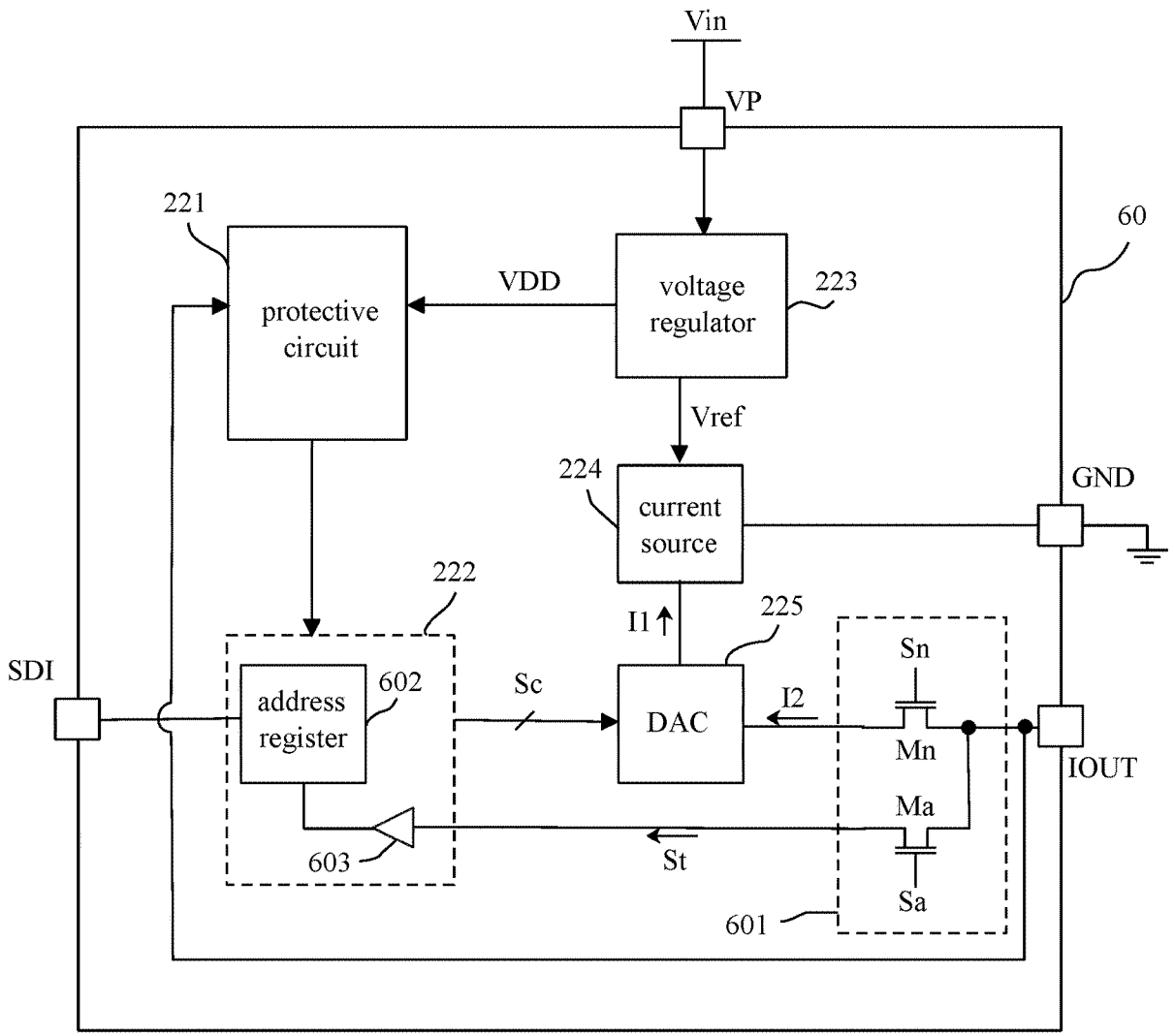
FIG. 6 shows an embodiment of the driving integrated circuit in FIG. 5.

FIG. 6 shows an embodiment of the driving integrated circuit 60 in FIG. 5. Similar to the driving integrated circuit 22 in FIG. 3, the driving integrated circuit 60 also includes a protective circuit 221, a controller 222, a voltage regulator 223, a current source 224, and a DAC 225. The driving integrated circuit 60 further includes a switching circuit 601. The switching circuit 601 includes two switches Mn and Ma which are respectively controlled by signals Sn and Sa. The signals Sn and Sa are provided by the controller 222 or other circuit. In a normal working mode, the switch Mn is turned on and the switch Ma is turned off, so the input/output pin IOUT is connected to the DAC 225. In an addressing mode, the switch Mn is turned off and the switch Ma is turned on, so the input/output pin IOUT is connected to the address register 602 in the controller 222 through a buffer 603. In the embodiment shown in FIG. 6, the address register 602 and the buffer 603 are disposed inside the controller 222. However, in other embodiments, the address register 602 and the buffer 603 may be disposed outside the controller 222. The architectures of the driving integrated circuits 62, 64 and 66 are similar to that of the driving integrated circuit 60 and will not repeat herein.

Refer to FIG. 5 and FIG. 6. After the LED backlight driving circuit 20 enters the addressing mode, the selecting circuits 30, 32, 34 and 36 select the driving integrated circuits for addressing. Only one of the driving integrated circuits 60 and 62, which are connected to the data transmission line DT1, can be addressed at the same time. Similarly, only one of the driving integrated circuits 64 and 66, which are connected to the data transmission line DT2, can be addressed at the same time. During the addressing mode, the input Vin is modified to a lower voltage. At this time, the input voltage Vin is unable to drive LEDs L11, L12, L2 land L22. Therefore, no current flows through LEDs L11, L12, L21 and L22. In the switching circuit 601, the switch Mn is turned off, and the switch Ma is turned on. While the switch M11 of the selecting circuit 30 is turned on, it means that the corresponding driving integrated circuit 60 is selected for addressing. At this time, a signal St is generated and provided to the address register 602 through the switch M11, the switch Ma and the buffer 603. The address register 602 is triggered by the signal St to store the address Sad11 from the data transmission line DT1. The signal St may be a voltage or a current. After the addressing of the driving integrated circuit 60 is completed, the switch M11 of the selecting circuit 30 is turned off. Next, the switch M12 of the selecting circuit 32 is turned on for addressing the driving integrated circuit 62. Similarly, after the switch M12 is turned on, a signal St is generated to trigger the address register 602 of the driving integrated circuit 62 to store the address Sad12 from the data transmission line DT1. The way of addressing the driving integrated circuits 64 and 66, which are connected to the data transmission line DT2, is the same as that of the driving integrated circuits 60 and 62 and will not repeat herein. In FIG. 5, the driving integrated circuits 60 and 64 are selected by the same signal CS1 for addressing; the driving integrated circuits 62 and 66 are selected by the same signal CS1 for addressing. However, in other embodiments, the driving integrated circuits 60 and 64 are respectively selected by different signals for addressing; the driving integrated circuits 62 and 66 are also respectively selected by different signals for addressing. After all the driving integrated circuits 60, 62, 64 and 66 have been addressed, the addressing mode ends. In one embodiment, the LED backlight driving circuit 20 enters the addressing mode in starting or during the vertical blank interval of a frame.

After the addressing mode ends, the LED backlight driving circuit 20 enters a normal working mode. Refer to FIG. 4, FIG. 5 and FIG. 6. In the normal working mode, the switches M11, M12, M21 and M22 are all turned off, and the input voltage Vin is restored to the normal voltage to drive LEDs L11, L12, L21 and L22. The data transmission lines DT1 and DT2 respectively provide brightness data BD1 and BD2. After receiving the brightness data BD1, the controllers 222 of the driving integrated circuits 60 and 62 acquire corresponding control data 42 and 46 from the brightness data BD1 according to the addresses Sad11 and Sad12 stored thereinside. Then, the controllers 222 generate the control signals Sc according to the acquired control data 42 and 46 to modify the currents supplied to LEDs L11 and L12 and control the brightness of LEDs L11 and L12. Similarly, the controllers 222 of the driving integrated circuits 64 and 66 acquire corresponding control data 50 and 54 from the brightness data BD2 according to the addresses Sad21 and Sad22 stored thereinside. Then, the controllers 222 generate the control signals Sc according to the acquired control data 50 and 54 to control the brightness of LEDs L11 and L12.

Figure 7:
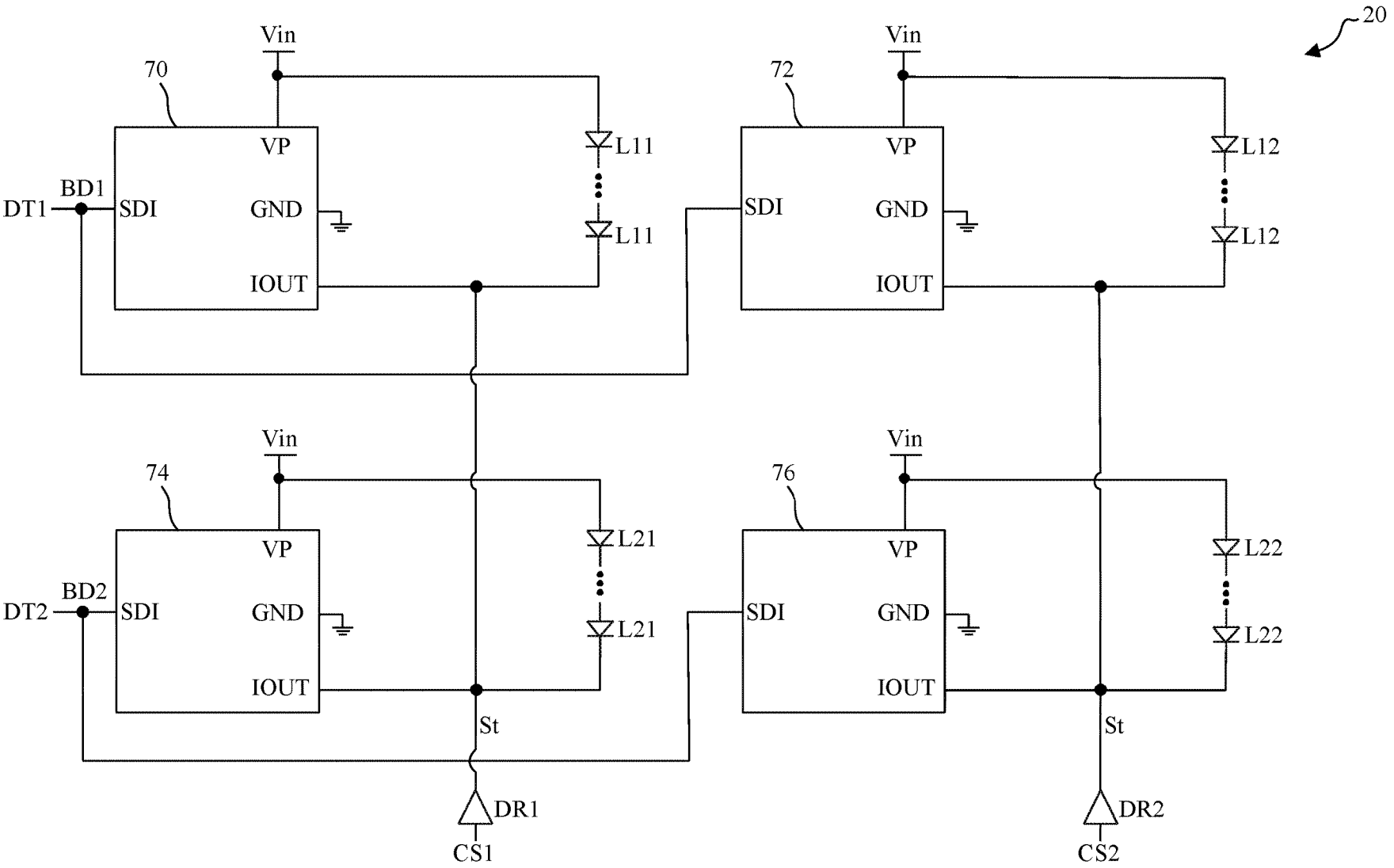
FIG. 7 shows a third embodiment of a LED backlight driving circuit of the present invention.

FIG. 7 shows a third embodiment of the LED backlight driving circuit 20. The LED backlight driving circuit 20 comprises a plurality of driving integrated circuits 70 and 72 connected to a data transmission line DT1 and a plurality of driving integrated circuits 74 and 76 connected to a data transmission line DT2. Each of the driving integrated circuits 70, 72, 74 and 76 has a power pin VP connected to an input voltage Vin, a ground pin GND connected to a ground terminal, an input/output pin IOUT connected to driver circuits DR1 or DR2 and at least one of LEDs L11, L12, L21 and L22, and a data input pin SDI coupled to the data transmission line DT1 or DT2. Please refer to the driving integrated circuit 60 in FIG. 6 for the architectures of the driving integrated circuits 70, 72, 74 and 76. In an addressing mode, the signals CS1 and CS2 trigger one of the driver circuits DR1 and DR2. The triggered driver circuit DR1 or DR2 generates a signal St to the input/output pins IOUT of the driving integrated circuits 70 and 74 or the input/output pins IOUT of the driving integrated circuits 72 and 76 for addressing. In one embodiment, the signals CS1 and CS2 are provided by a voltage driver outside the LED backlight driving circuit 20.

Refer to FIG. 6 and FIG. 7. After the LED backlight driving circuit 20 enters the addressing mode, the signals CS1 and CS2 are used to select the driving integrated circuits for addressing. Only one of the driving integrated circuits 70 and 72, which are connected to the data transmission line DT1, can be addressed at the same time. Similarly, only one of the driving integrated circuits 74 and 76, which are connected to the data transmission line DT2, can be addressed at the same time. In other words, while the signal CS1 is provided to the driver circuit DR1, the signal CS2 is interrupted; while the signal CS2 is provided to the driver circuit DR2, the signal CS1 is interrupted. During the addressing mode, the input Vin is modified to a lower voltage. At this time, the input voltage Vin is unable to drive LEDs L11, L12, L21 and L22. Therefore, no current flows through LEDs L11, L12, L21, and L22. While the driving integrated circuit 70 is selected for addressing, the signal CS1 works, and the signal CS2 is interrupted. At this time, the driver circuit DR1 is triggered by the signal CS1 to generate a signal St. The signal St is sent through the input/output pins IOUT, the switch Ma and the buffer 603 to trigger the address register 602 of the driving integrated circuit 70, so the address Sad11 provided by the data transmission line DT1 is stored in the address register 602 of the driving integrated circuit 70. After the addressing of the driving integrated circuit 70 is completed, the signal CS1 is interrupted, and the signal CS2 works. At this time, the driver circuit DR2 is triggered by the signal CS2 to generate a signal St to trigger the address register 602 of the driving integrated circuit 72 for addressing and store the address Sad12 provided by the data transmission line DT1. The way to address the driving integrated circuits 74 and 76, which are connected to the data transmission line DT2, is the same as the way to address the driving integrated circuits 70 and 72 and will not repeat herein. After all the driving integrated circuits 70, 72, 74 and 76 have been addressed, the addressing mode ends. In one embodiment, the LED backlight driving circuit 20 may perform addressing in starting or during the vertical blank interval of a frame.

After the addressing mode ends, the LED backlight driving circuit 20 enters a normal working mode. Refer to FIG. 4 and FIG. 7. During the normal working mode, the signals CS1 and CS2 are interrupted; the data transmission line DT1 provides brightness data BD1 for the driving integrated circuits 70 and 72, and the data transmission line DT2 provides brightness data BD2 for the driving integrated circuits 74 and 76. After receiving the brightness data BD1, the controllers 222 of the driving integrated circuits 70 and 72 acquire corresponding control data 42 and 46 according to the addresses Sad11 and Sad12 stored thereinside to control the brightness of LEDs L11 and LEDs L12. Similarly, the controllers 222 of the driving integrated circuits 74 and 76 acquire corresponding control data 50 and 54 according to the addresses Sad21 and Sad22 stored thereinside to control the brightness of LEDs L21 and LEDs L22.

The embodiments have been described above to demonstrate the principles of the present invention and enable the persons skilled in the art to understand, make, and use the present invention. However, these embodiments are only to exemplify the present invention but not to limit the scope of the present invention. The technical thought and scope of the present invention is defined by the claims stated below and the equivalents thereof. Any modification or variation according to the principle, spirit or embodiment of the present invention is to be also included by the scope of the present invention.

What is claimed is:

1. A light-emitting-diode backlight driving circuit for driving a plurality of light emitting diodes, comprising:

a data transmission line configured to provide brightness data in a normal working mode;

a plurality of driving integrated circuits coupled to said data transmission line and configured to drive said plurality of light emitting diodes according to said brightness data in said normal working mode; and a plurality of selecting circuits respectively connected to said plurality of driving integrated circuits and configured to select driving integrated circuits for addressing from said plurality of driving integrated circuits in an addressing mode;

wherein only one driving integrated circuit is selected for addressing from said plurality of driving integrated circuits at a time point.

2. The light-emitting-diode backlight driving circuit according to claim 1, wherein each of said plurality of driving integrated circuits comprises:

a data input pin configured to receive an address from said data transmission line in said addressing mode, and configured to receive said brightness data in said normal working mode;

a power pin configured to receive an input voltage;

a ground pin connected to a ground terminal; and an input/output pin connected to at least one of said plurality of light emitting diodes.

3. The light-emitting-diode backlight driving circuit according to claim 2, wherein each of said plurality of selecting circuits comprises a switch connected between said data input pin of corresponding driving integrated circuit and said data transmission line.

4. The light-emitting-diode backlight driving circuit according to claim 2, wherein each of said plurality of selecting circuits comprises a switch connected between said power pin and said input/output pin of corresponding driving integrated circuit.

5. The light-emitting-diode backlight driving circuit according to claim 4, wherein each of said plurality of driving integrated circuits further comprises an address register connected to said data transmission line via said data input pin; and a switching circuit coupled to said address register and said input/output pin, and configured to connect said input/output pin to said address register in said addressing mode;

wherein in said addressing mode, a signal of said input/output pin triggers said address register to store said address from said data transmission line.

6. A light-emitting-diode backlight driving circuit for driving a plurality of light emitting diodes, comprising:

a data transmission line configured to provide brightness data in a normal working mode; and a plurality of driving integrated circuits coupled to said data transmission line and configured to drive said plurality of light emitting diodes according to said brightness data in said normal working mode;

wherein in an addressing mode, a signal is provided to one of said plurality of driving integrated circuits to select driving integrated circuits for addressing.

7. The light-emitting-diode backlight driving circuit according to claim 6, wherein each of said plurality of driving integrated circuits comprises:

a data input pin configured to receive an address from said data transmission line in said addressing mode, and configured to receive said brightness data in said normal working mode;

a power pin configured to receive an input voltage;

a ground pin connected to a ground terminal; and an input/output pin connected to at least one of said plurality of light emitting diodes.

8. The light-emitting-diode backlight driving circuit according to claim 7, wherein said signal is provided to said input/output pin.

9. The light-emitting-diode backlight driving circuit according to claim 8, wherein each of said plurality of driving integrated circuits further comprises:

an address register connected to said data transmission line via said data input pin; and a switching circuit coupled to said address register and said input/output pin, and configured to connect said input/output pin to said address register in said addressing mode;

wherein in said addressing mode, said signal triggers said address register to store said address from said data transmission line.

10. An addressing method for a light-emitting-diode backlight driving circuit, comprising:

A. in an addressing mode, selecting one driving integrated circuit for addressing from a plurality of driving integrated circuits sharing a common data transmission line;

B. providing an address for selected driving integrated circuit; and

C. repeating said Step A and said Step B until said plurality of driving integrated circuits all acquire addresses, wherein in a normal working mode, said data transmission line provides brightness data for said plurality of driving integrated circuits, and said plurality of driving integrated circuits drive light emitting diodes connected thereto according to said brightness data.

11. The addressing method according to claim 10, wherein each of said plurality of driving integrated circuits comprises:

a data input pin configured to receive an address from said data transmission line in said addressing mode;

a power pin configured to receive an input voltage;

a ground pin connected to a ground terminal; and an input/output pin connected to a light emitting diode.

12. The addressing method according to claim 11, wherein said Step A further comprises steps:

connecting said data input pin of said selected driving integrated circuit to said data transmission line;

disconnecting said data input pins of driving integrated circuits which are not selected for addressing from said data transmission line.

13. The addressing method according to claim 11, wherein said Step A further comprises steps:

connecting said power pin of said selected driving integrated circuit directly to said input/output pin; and connecting an address register of said selected driving integrated circuit to said input/output pin to trigger said address register to store said address.

14. The addressing method according to claim 11, wherein said Step A further comprises steps:

connecting said input/output pin of said selected driving integrated circuit to an address register inside said selected driving integrated circuit; and providing a signal for said input/output pin of said selected driving integrated circuit to trigger said address register to store said address.

* * * * *